US010250967B2

(12) United States Patent
Lippitt et al.

(10) Patent No.: US 10,250,967 B2
(45) Date of Patent: Apr. 2, 2019

(54) SPEAKER MODULES HAVING DIFFERENT MODULE HOUSING GEOMETRIES AND SIMILAR ACOUSTIC PROPERTIES

(71) Applicant: Bose Corporation, Framingham, MA (US)

(72) Inventors: Benjamin C. Lippitt, Worcester, MA (US); Greg Joseph Zastoupil, North Grafton, MA (US); Randy J. Kulchy, Shrewsbury, MA (US); Kevin Brousseau, Newton, MA (US)

(73) Assignee: Bose Corporation, Framingham, MA (US)

( * ) Notice: Subject to any disclaimer, the term of this patent is extended or adjusted under 35 U.S.C. 154(b) by 134 days.

(21) Appl. No.: 15/067,939

(22) Filed: Mar. 11, 2016

(65) Prior Publication Data

US 2017/0264995 A1 Sep. 14, 2017

(51) Int. Cl.
*H04R 1/24* (2006.01)
*H04R 1/02* (2006.01)
(Continued)

(52) U.S. Cl.
CPC ..... *H04R 1/24* (2013.01); *H04R 1/02* (2013.01); *H04R 1/025* (2013.01); *H04R 1/403* (2013.01);
(Continued)

(58) Field of Classification Search
CPC . H04R 1/24; H04R 1/025; H04R 1/02; H04R 3/12; H04R 1/403; H04R 1/227;
(Continued)

(56) References Cited

U.S. PATENT DOCUMENTS 4,790,407 A * 12/1988 Yamamoto ..... H04R 1/2819 181/141
4,815,559 A * 3/1989 Shirley ..... H04R 1/02 181/144

(Continued)

FOREIGN PATENT DOCUMENTS

EP 1686830 A1 8/2006
WO 2004006621 A1 1/2004

OTHER PUBLICATIONS

International Search Report & Written Opinion in counterpart International Patent Application No. PCT/US17/18881, dated May 18, 2017; 14 pages.

(Continued)

*Primary Examiner* — Jason R Kurr
(74) *Attorney, Agent, or Firm* — Schmeiser, Olsen & Watts LLP; William G. Guerin

(57) ABSTRACT

An array of speaker modules includes a first speaker module having at least one electroacoustic driver and a housing that together define a first acoustic cavity having a first cavity volume. The array also includes a second speaker module having at least one electroacoustic driver and a housing that together define a first enclosed volume that is greater than the first cavity volume by a first volume difference. The second speaker module includes a first internal enclosure having a first internal volume that is substantially equal to the first volume difference. The portion of the first enclosed volume that is outside the first internal volume defines a second acoustic cavity having a second cavity volume that is substantially equal to the first cavity volume. This configuration enables the performance of low frequency acoustic drivers in the speaker modules to be substantially matched without requiring complicated alternative approaches for matched performance.

26 Claims, 7 Drawing Sheets

(51) Int. Cl.

| | |
|---|---|
| ***H04R 3/12*** | (2006.01) |
| ***H04R 1/40*** | (2006.01) |
| *H04R 1/22* | (2006.01) |
| *H04R 1/28* | (2006.01) |
| *H04R 27/00* | (2006.01) |

(52) U.S. Cl.
CPC ..... *H04R 3/12* (2013.01); *H04R 1/227* (2013.01); *H04R 1/2811* (2013.01); *H04R 27/00* (2013.01); *H04R 2201/403* (2013.01)

(58) Field of Classification Search
CPC . H04R 1/2811; H04R 27/00; H04R 2201/403
See application file for complete search history.

(56) References Cited

U.S. PATENT DOCUMENTS 5,082,084 A * 1/1992 Ye-Ming ..... H04R 1/021 181/153
5,793,000 A * 8/1998 Sabato ..... H04R 1/025 181/151
7,506,721 B2 * 3/2009 Moore ..... H04R 1/2865 181/148
8,807,269 B1 8/2014 Lucy
2006/0269095 A1 * 11/2006 Matsumura ..... H04R 1/2803 381/421
2007/0064970 A1 * 3/2007 Yang ..... H04R 1/2803 381/388
2009/0065293 A1 3/2009 Moore
2015/0358734 A1 * 12/2015 Butler ..... H04R 3/12 381/59
2015/0365758 A1 * 12/2015 Bridge ..... H04R 1/345 381/337

OTHER PUBLICATIONS

International Preliminary Report on Patentability in PCT/US17/18881 dated Sep. 20, 2018; 8 pages.

* cited by examiner

SPEAKER MODULES HAVING DIFFERENT MODULE HOUSING GEOMETRIES AND SIMILAR ACOUSTIC PROPERTIES

BACKGROUND

This description relates generally to acoustic speaker arrays. More specifically, this description relates to an array of two or more speaker modules having similar acoustic performance despite different module housing geometries.

SUMMARY

In one aspect, an array of speaker modules includes a first speaker module having at least one electroacoustic driver and a housing that together define a first acoustic cavity having a first cavity volume. The array of speaker modules also includes a second speaker module having at least one electroacoustic driver and a housing that together define a first enclosed volume that is greater than the first cavity volume by a first volume difference. The second speaker module further includes a first internal enclosure having a first internal volume that is substantially equal to the first volume difference. A portion of the first enclosed volume that is outside of the first internal volume defines a second acoustic cavity having a second cavity volume that is substantially equal to the first cavity volume.

Examples may include one or more of the following features:

The housings of the first and second speaker modules may include a plurality of panels and the first internal enclosure may include a plurality of internal panels. Each of the internal panels is fixed to at least one of the panels of the housing of the second speaker module and the other internal panels. The housing of each of the first and second speaker modules may include at least one acoustic port. The housings of the first and second speaker modules may include a top panel and a bottom panel having a wedge angle defined therebetween. The wedge angle of the first speaker module may be different from the wedge angle of the second speaker module.

At least one of the internal panels may be a curved panel.

The first internal enclosure may include a single internal panel fixed to at least one of the panels of the housing of the second speaker module and may be box-shaped. The first internal enclosure may be a solid mass of material.

The at least one acoustic driver may include a pair of woofers and may further include a plurality of compression drivers. A plurality of driver ports may be disposed between the woofers with each of the driver ports being in communication with a respective one of the compression drivers through an acoustic channel.

The array of speaker modules may include a third speaker module having at least one electroacoustic driver and a housing that together define a second enclosed volume that is greater than the first cavity volume by a second volume difference. The third speaker module may include a second internal enclosure having a second internal volume that is substantially equal to the second volume difference. A portion of the second enclosed volume that is outside of the second internal volume defines a third acoustic cavity having a third cavity volume that is substantially equal to the first and second cavity volumes. The first enclosed volume and the second enclosed volume may not be equal volumes and the first internal volume and the second internal volume may not be equal volumes.

In accordance with another aspect, an array of speaker modules includes a first speaker module having a plurality of electroacoustic drivers and a first housing that together define a first acoustic cavity having a first cavity volume. The first speaker module has a plurality of acoustic ports and the first housing has a first pair of opposing panels that defines a first wedge angle. The array of speaker modules further includes a second speaker module having a plurality of electroacoustic drivers and a second housing that together define a first enclosed volume that is greater than the first cavity volume by a first volume difference. The second housing has a second pair of opposing panels that defines a second wedge angle. One of the opposing panels in the second pair of opposing panels is parallel and substantially adjacent to one of the opposing panels in the first pair of opposing panels. The second speaker module further includes a plurality of acoustic ports and a first internal enclosure having a first internal volume that is substantially equal to the first volume difference. The first wedge angle and the second wedge angle are not equal and a portion of the first enclosed volume that is outside of the first internal volume defines a second acoustic cavity having a second cavity volume that is substantially equal to the first cavity volume.

Examples may include one or more of the following features:

The first and second housings may each include a plurality of panels and the internal enclosure may include a plurality of internal panels with each of the internal panels being fixed to at least one of the panels of the second housing and the other internal panels. At least one of the internal panels may be a curved panel.

The internal enclosure may be a box-shaped enclosure.

At least one of the electroacoustic drivers may be a woofer and at least one of the other acoustic drivers may be a compression driver.

In accordance with another aspect, a speaker module having a configurable acoustic cavity includes at least one acoustic driver, a housing and at least one internal panel. The housing, together with the at least one electroacoustic driver, defines an enclosed volume. The at least one internal panel attached to the housing thereby defines an internal volume within the enclosed volume. The enclosed volume outside of the internal volume has a volume that substantially equals a predetermined volume.

Examples may include one or more of the following features:

The speaker module may be a first speaker module configured for attachment to a second speaker module with the predetermined volume being substantially equal to a volume of an acoustic cavity of the second speaker module.

A plurality of acoustic ports may extend from outside the housing to the enclosed volume. The at least one internal panel may include a curved panel.

The at least one electroacoustic driver may include a woofer and/or a compression driver.

BRIEF DESCRIPTION OF THE DRAWINGS

The above and further advantages of examples of the present inventive concepts may be better understood by referring to the following description in conjunction with the accompanying drawings, in which like numerals indicate like structural elements and features in various figures. The drawings are not necessarily to scale, emphasis instead being placed upon illustrating the principles of features and implementations.

DETAILED DESCRIPTION

Figure 1A:
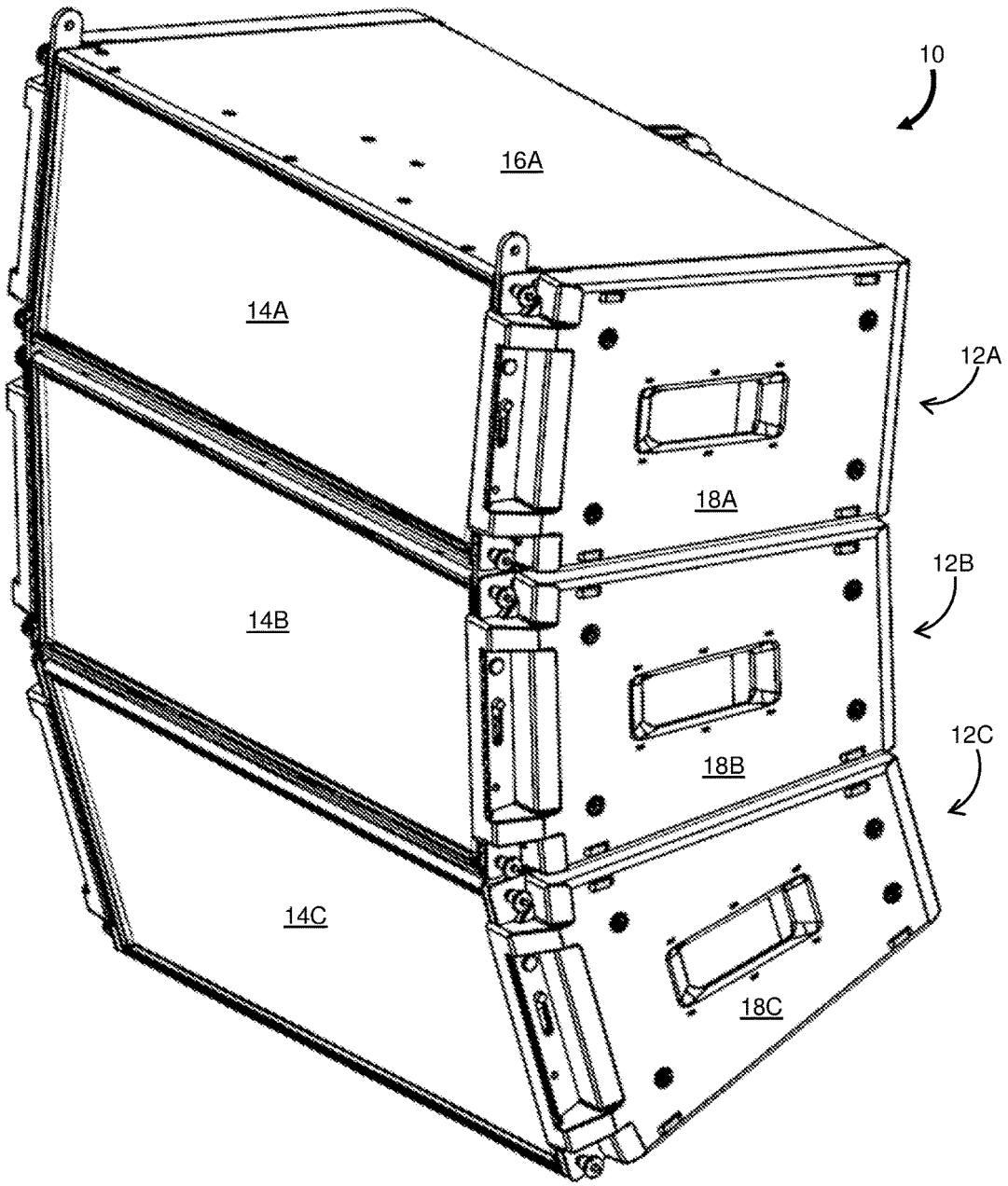
FIG. 1A and FIG. 1B are perspective views of an example of an array of speaker modules with and without acoustically-transparent front screens.

As used herein, an electroacoustic driver means a source of an acoustic signal that is controlled by an electrical signal, such as an acoustic transducer. The electroacoustic driver may produce an acoustic signal across a wide range of acoustic frequencies, including by way of example, at least a portion of a frequency spectrum extending from a few Hertz to greater than 20 KHz.

The specification uses words such as top, bottom, upper, lower, back, front and the like. These words are intended for description of the relative location of features and elements shown in the drawings. It should be recognized that in other views or in other examples, similar features and elements may be referred to with other descriptions or location identifiers.

As used herein, the term substantially is to be understood to mean approximately the same. For example, "substantially equal to" includes values that are not exactly the same but are within a range of a particular value such that a desired result associated with an exact equality is still achieved.

Various examples described below allow for fabrication of speaker modules having similar acoustic elements but different module geometries to achieve similar acoustic performance. The different module geometries permit the speaker modules to be arranged in an array (e.g., a curvilinear array) to achieve a desired acoustic coverage pattern. Modification of the internal structure of one or more of the modules in the array results in all modules having substantially the same acoustic cavity volume. Low frequency electroacoustic drivers are particularly sensitive to the volume of the acoustic cavity. Using the speaker module construction described herein allow for the performances of all the low frequency electroacoustic drivers to be well matched despite the different speaker module geometries. Moreover, the ability to quickly modify the internal speaker module construction of one or more of the speaker modules avoids more complicated alternative approaches such as providing different acoustic ports for different modules and maintaining different equalization (EQ) profiles for the electroacoustic drivers according to their particular module geometry. Maintaining identical EQ profiles for all modules allows for a reduction in cabling complexity. For example, the number of cables extending from an amplifier to an array of speaker modules can be reduced by "daisy-chaining" two or more speaker modules according to power requirements and electrical properties of the cable.

Figure 1B:
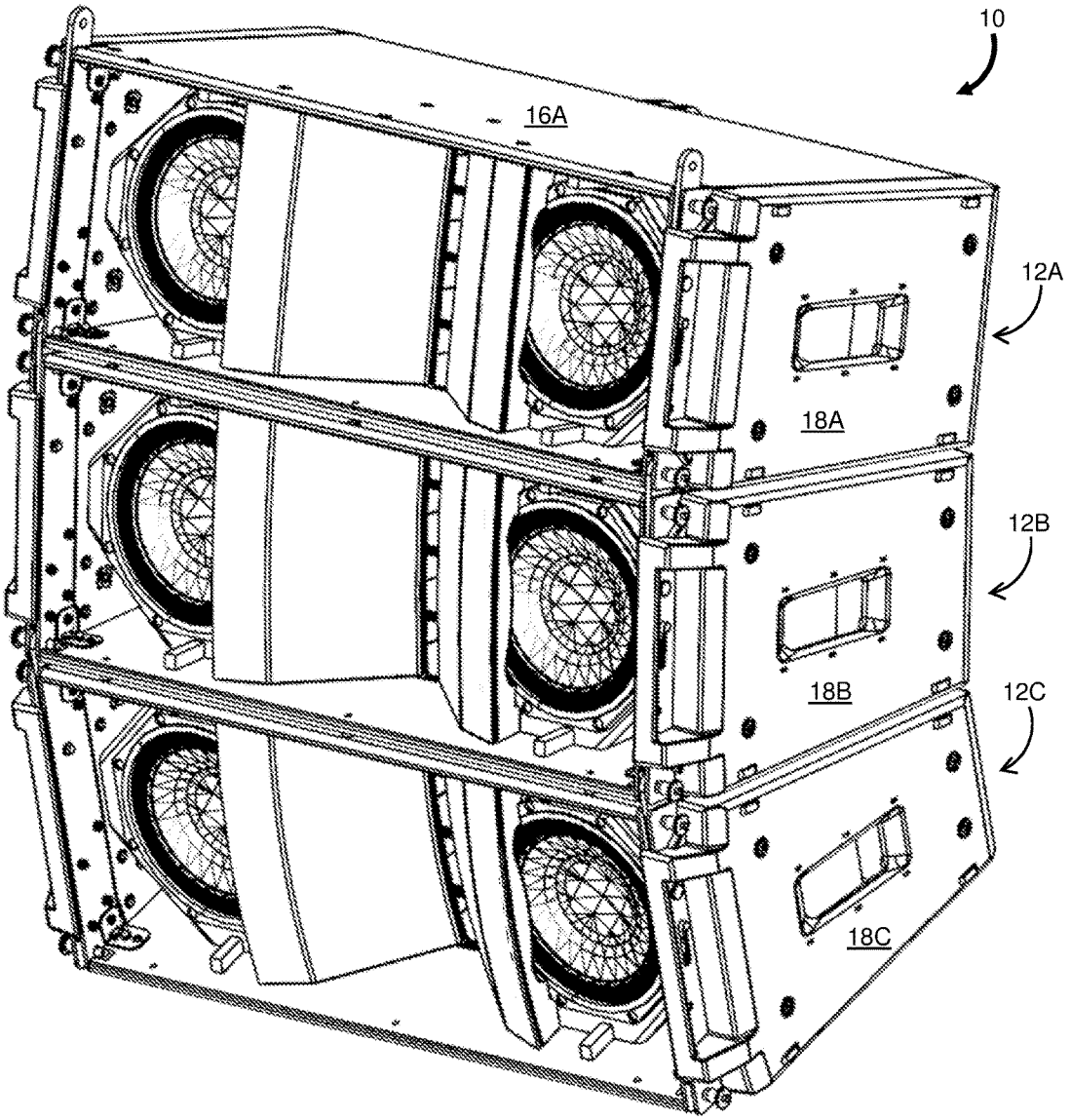

FIG. 1A is a perspective view showing an example of an array 10 of three speaker modules 12A, 12B and 12C and FIG. 1B is a perspective view of the array 10 showing the three modules 12 without their acoustically-transparent screens 14. The modules 12 are stacked vertically and attached to each other so that the top of the lower module 12C is parallel to the bottom of the middle module 12B, and the top of the middle module 12B is parallel to the bottom of the upper module 12A. The modules 12 are secured to each other to form a vertical array that may be positioned at a location to obtain a particular acoustic field coverage. In alternative examples, only two modules 12 may be used or four or more modules 12 may be used. To provide a desired acoustic environment, any number of speaker module arrays 10 may be deployed. The speaker module arrays 10 may be suspended from a ceiling or other structure, or stacked on the ground, about a stage, sports arena, auditorium and the like.

Figure 2:
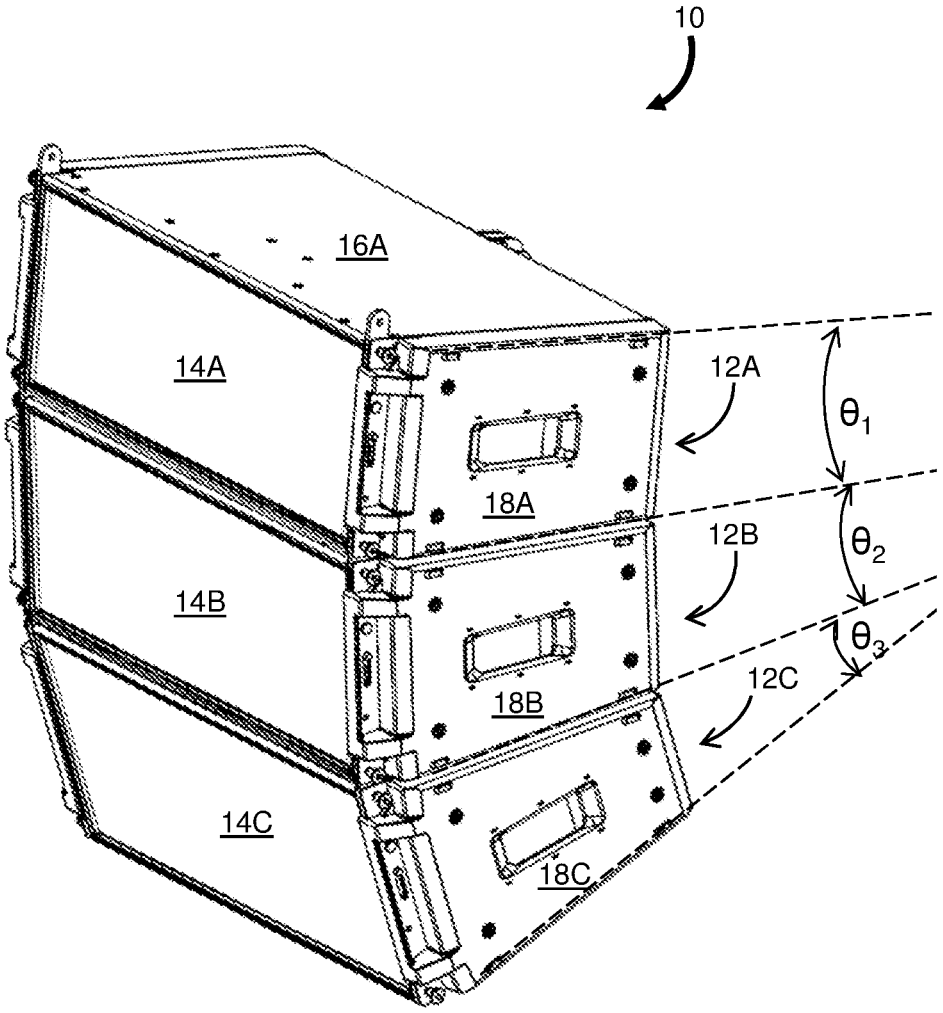
FIG. 2 is another perspective view of the array of speaker modules of FIG. 1A showing the different wedge angles.
Figure 3A:
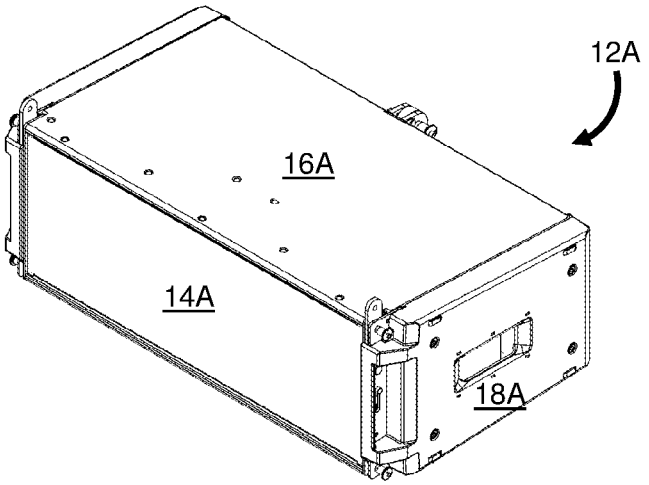
FIG. 3A, FIG. 3B and FIG. 3C are perspective views of the individual speaker modules of FIG. 2.
Figure 3B:
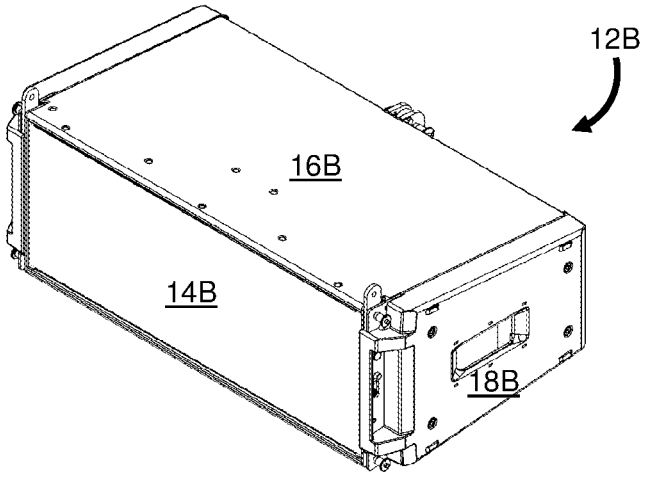
Figure 3C:
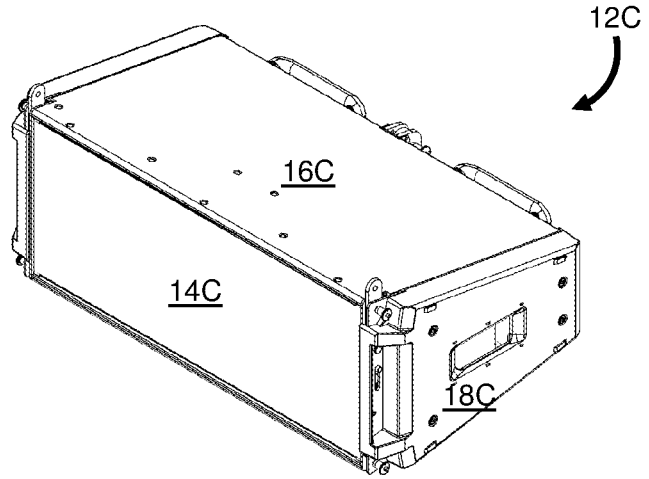

FIG. 2 is a perspective view of the speaker array 10 similar to that of FIG. 1A but at a greater viewing distance. FIG. 3A, FIG. 3B and FIG. 3C show the individual speaker modules 12 of FIG. 2 separated from each other. Each module 12 has a front screen 14, a back panel (not visible), a top panel 16, a bottom panel (not visible) and a pair of side panels 18. By way of non-limiting examples, the panels can be fabricated from wood (e.g., plywood or medium-density fiberboard (MDF)), particle board, foam, plastic or metal. In an alternative to the illustrated example, one or more of the panels 16 and 18 may be curved or have another non-planar shape.

Figure 4A:
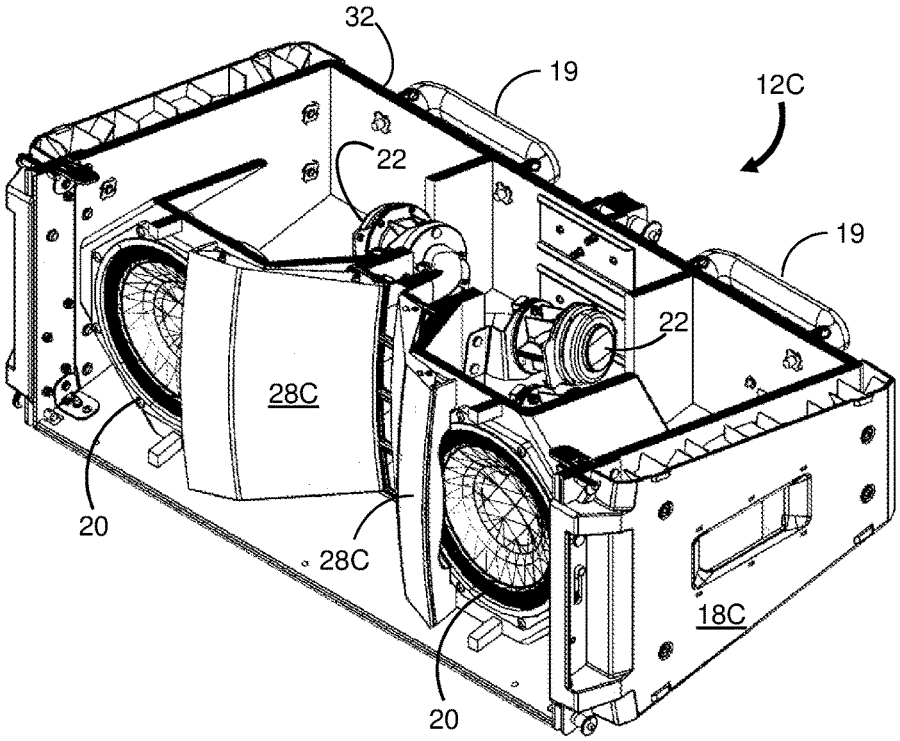
FIG. 4A, FIG. 4B and FIG. 4C are a perspective view, front view and top view, respectively, of the lower speaker module shown in FIG. 3C with the front acoustically-transparent screen and top panel removed.
Figure 4B:
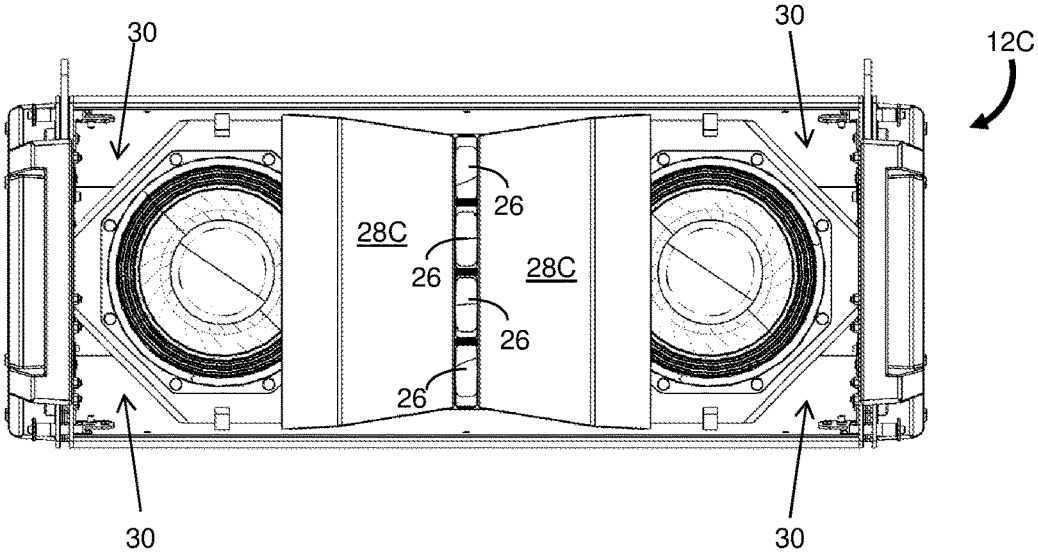
Figure 4C:
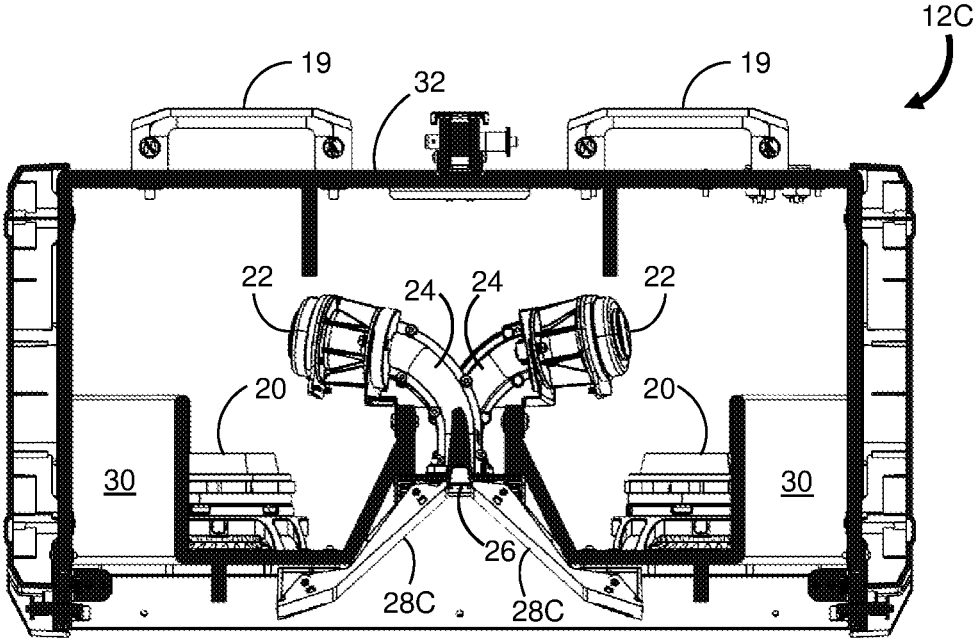

FIG. 4A, FIG. 4B and FIG. 4C are a perspective view, front view and top view, respectively, of the smallest speaker module 12C with the front screen 14C and top panel 16C removed. A pair of handles 19 extends outward from the back panel 32. The module 12C includes a pair of low frequency electroacoustic drivers ("woofers") 20 disposed at the front. The woofers 20, in combination with the five panels, define a housing that encloses four higher frequency electroacoustic drivers (compression drivers) 22 (only the top driver on each side is visible), acoustic conduits 24 and other components and structures within an enclosed volume. Driver ports 26 are disposed at the end of the acoustic conduits 24 and arranged vertically along a diffraction slot at the front of the module 12 between horn walls 28C. The acoustic cavity of the module 12C is defined by the unoccupied volume within the enclosed volume. Four acoustic ports 30 leading to the acoustic cavity are provided at the front of the module 12C. The other modules 12A and 12B include similar electroacoustic drivers and structures. In addition, the port cross-sectional areas and port lengths of the acoustic ports 30 are kept the same for all the modules 12.

Referring again to FIG. 2 speaker module 12A is constructed with a vertical wedge angle $\theta_1$ defined between its upper surface 16A and lower surface (not visible). Similarly, module 12B has a wedge angle $\theta_2$ defined between its upper surface 16B and lower surface, and module 12C has a wedge angle $\theta_3$ defined between its upper surface 16C and lower surface. For example, $\theta_1$ may be 5°, $\theta_2$ may be 10° and $\theta_3$ may be 20°. Thus each speaker module 12 has a different geometry and a different volume enclosed by its housing.

The angular acoustic output patterns from each module 12 differ in the vertical direction and, because each module 12 is angled with respect to the other modules 12, the centerline of the acoustic energy propagating from each module 12 is in a different vertical direction. Stated otherwise, each module 12 has a different vertical coverage angle and is pointed in a different vertical direction, the arrangement of the array allowing acoustic energy to be propagated in a smoothly continuous fashion across a larger vertical angle than possible with a single module 12. Each module 12 provides a similar acoustic performance across the acoustic spectrum which, for example, may extend from a few Hertz to greater than 20 KHz. It should be noted that the magnitude of the acoustic energy along the direction of acoustic propagation varies between modules 12 according the different vertical coverage angles.

Based on the different module housing geometries due in part to the different wedge angles θ, the enclosed volumes are different. More specifically, the upper module 12A has an enclosed volume $V_A$ that is greater than the enclosed volume $V_C$ of the lower module 12C by a volume difference $\Delta V_{AC}$. Similarly, the middle module 12B has an enclosed volume $V_B$ that is greater that the enclosed volume $V_C$ of the lower module 12C by a volume difference $\Delta V_{BC}$.

Figure 5A:
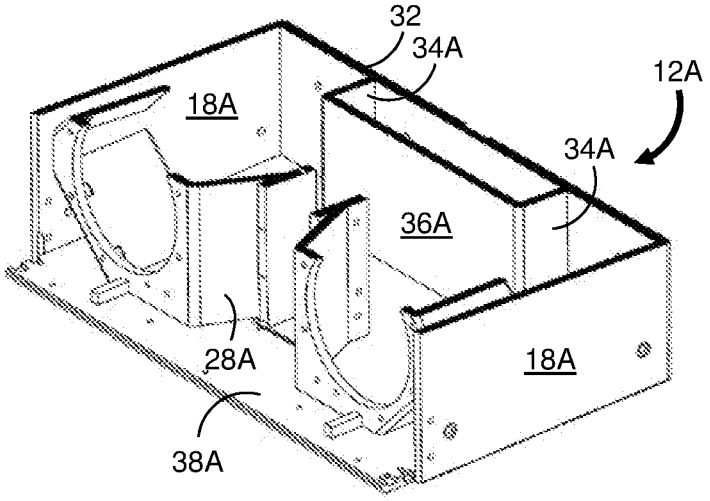
FIG. 5A, FIG. 5B and FIG. 5C show a perspective view of the basic structure of the three speaker modules with various components removed to better show the enclosed volumes.
Figure 5B:
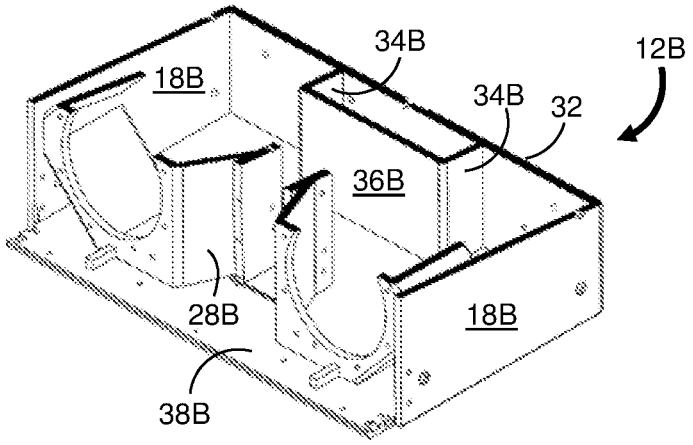
Figure 5C:
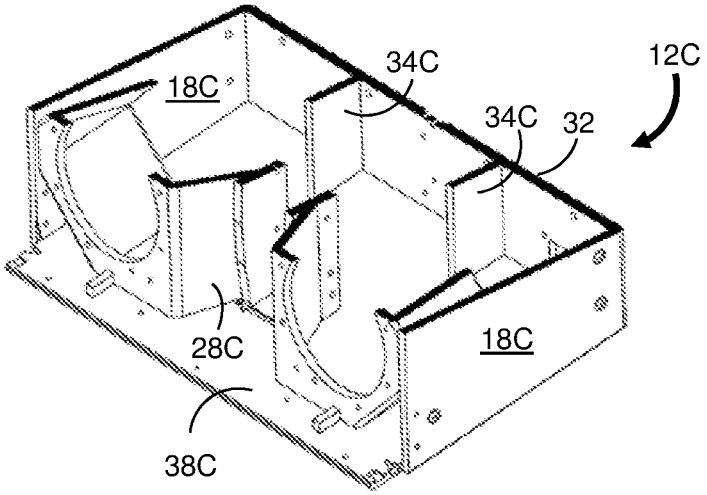

As a result of the different enclosed volumes, the acoustic performances of the speaker modules 12 would be different, especially with respect to the performance of the woofers 20; however, the modules 14A and 14B having the larger enclosed volumes include an internal enclosure within the enclosed volume. FIG. 5A, FIG. 5B and FIG. 5C show a perspective view of the basic structure of speaker modules 12A, 12B and 12C, respectively, with the electroacoustic drivers 20 and 22, acoustic conduits 24 and other components removed for clarity in viewing the acoustic cavities. The upper speaker module 12A includes an internal enclosure having a generally rectangular box shape and defined by a portion of the back panel 32A, two internal side panels 34A, an internal front panel 36A, and portions of the bottom panel 38A and top panel 16A (see FIG. 3A). Similarly, the middle speaker module 12B includes a box shaped enclosure defined by a portion of the back panel 32B, internal side panels 34B an internal front panel 36B and portions of the bottom panel 38B and top panel 16B (see FIG. 3B). The spacing between the internal side panels 34 for each module 12A or 12B are different although this is not a requirement. In addition, the dimensions of the internal side panels 34 and the internal front panels 36 for each module 36 are generally different. In the illustrated example, the internal volume is defined by the "sealed" volume of air as well as the volumes of the internal side panels 34 and internal front panel 36.

The internal volume of the internal enclosure inside the upper speaker module 12A is equal to the volume difference $\Delta V_{AC}$ and the internal volume of the internal enclosure inside the middle speaker module 12B is equal to the volume difference $\Delta V_{BC}$. As a result, the volumes of the corresponding acoustic cavities as defined by the portions of the enclosed volumes $V_A$ and $V_B$ that are exclusive of (i.e., outside) the respective internal volumes are substantially the same as the enclosed volume (and acoustic cavity volume) $V_C$ of the lower speaker module 12C. As a result of similar acoustic components and acoustic cavity volumes, the three modules 12 are substantially matched in acoustic performance.

Advantageously, the internal enclosure for a speaker module 12 can be easily assembled by securing the side panels 34 to the back panel 32, bottom panel 38 and/or top panel 16, and by securing the internal front panel 36 to the side panels 34, bottom panel 38 and or top panel 16. The panels may be secured using any known means such as screws, bolts, staples and other fasteners, as well as adhesives or small features provided within panels to allow for interference fit. The panels can include slots to engage one or more of the other panels to provide for accurate positioning and alignment. Advantageously, securing the internal panels 34 and 36 to the back panel 32 and optionally to the upper and/or lower panels 16 and 38 can reinforce the structure of the module 12. Although no internal enclosure may be formed in the smallest module 12C, internal side panels 34C provide additional structural reinforcement.

In one example, the panels of at least the larger speaker modules 12 are provided with an excess number of attachment means such as pilot holes, tabs, grooves and the like for attaching the internal panels. During assembly of a module 12, the internal panel sizes are selected to achieve the desired internal volume and acoustic cavity volume. Although the illustrated array includes three speaker modules, other examples may include two speaker modules or four or more speaker modules. In addition, the speaker module array and associated wedge angles are defined in a vertical plane; however, it will be appreciated that the array and wedge angles may be in a horizontal plane and the matching of the volumes of the acoustic cavities of the speaker modules is achieved in a similar manner. Furthermore, the housing and internal enclosures are shown as generally box-shaped enclosures; however, it should be recognized that other shapes are contemplated. The particular shapes may be determined in response to available (i.e., unpopulated) space within the enclosed volume of the speaker module. Moreover, the shape and/or number of internal panels used to define the internal enclosure can be different. For example, one or more internal panels may be curved. Moreover, the number of internal panels may be different. In one example, two or more of the flat panels described above are formed as a single part.

In other alternative examples, the internal enclosure includes two or more sub-enclosures for which the sum of their internal volumes is equal to that of the volume of a single internal enclosure as described above. Such an arrangement can be advantageous if the components inside a speaker module would otherwise interfere with the single internal enclosure. In other alternative examples, the internal enclosure may be formed from a solid mass or block of material, for example, from one or more foam or wood elements sized to occupy the full volume of the internal enclosure. The structure may not be entirely solid, that is, the structure may include one or more internal spaces or voids.

A number of implementations have been described. Nevertheless, it will be understood that the foregoing description is intended to illustrate, and not to limit, the scope of the inventive concepts which are defined by the scope of the claims. Other examples are within the scope of the following claims.

What is claimed is:

1. An array of speaker modules, comprising:

a first speaker module having at least one electroacoustic driver and a housing that together define a first cavity having a first enclosed volume;

a second speaker module having at least one electroacoustic driver and a housing that together define a second cavity having a second enclosed volume that is greater than the first enclosed volume by a first volume difference, the second speaker module further including a first internal enclosure having a first internal volume that is substantially equal to the first volume difference, wherein a portion of the second enclosed volume that is exclusive of the first internal volume defines a volume that is substantially equal to the first enclosed volume.

2. The array of speaker modules of claim 1 wherein the housings of the first and second speaker modules comprise a plurality of panels and wherein the first internal enclosure comprises a plurality of internal panels, each of the internal panels being fixed to at least one of the panels of the housing of the second speaker module and the other internal panels.

3. The array of speaker modules of claim 1 wherein the first internal enclosure comprises a single internal panel fixed to at least one of the panels of the housing of the second speaker module.

4. The array of speaker modules of claim 1 wherein the first internal enclosure is a box-shaped enclosure.

5. The array of speaker modules of claim 1 further comprising:

a third speaker module having at least one electroacoustic driver and a housing that together define a third cavity having a third enclosed volume that is greater than the first enclosed volume by a second volume difference, the third speaker module further including a second internal enclosure having a second internal volume that is substantially equal to the second volume difference, wherein a portion of the third enclosed volume that is exclusive of the second internal volume defines a volume that is substantially equal to the first and second cavity volumes.

6. The array of speaker modules of claim 5 wherein the second enclosed volume and the third enclosed volume are not equal.

7. The array of speaker modules of claim 5 wherein the first internal volume and the second internal volume are not equal.

8. The array of speaker modules of claim 1 wherein the first internal enclosure comprises a solid mass of material.

9. The array of speaker modules of claim 1 wherein the housing of each of the first and second speaker modules includes at least one acoustic port.

10. The array of speaker modules of claim 1 wherein at least one of the internal panels is a curved panel.

11. The array of speaker modules of claim 1 wherein the at least one electroacoustic driver comprises a pair of woofers.

12. The array of speaker modules of claim 11 wherein the at least one electroacoustic driver further comprises a plurality of compression drivers.

13. The array of speaker modules of claim 12 further comprising a plurality of driver ports disposed between the woofers, each of the driver ports in communication with a respective one of the compression drivers through an acoustic channel.

14. The array of speaker modules of claim 1 wherein the housings of the first and second speaker modules include a top panel and a bottom panel defining a wedge angle therebetween.

15. The array of speaker modules of claim 14 wherein the wedge angle of the first speaker module is different from the wedge angle of the second speaker module.

16. An array of speaker modules comprising:

a first speaker module having a plurality of electroacoustic drivers and a first housing that together define a first cavity having a first enclosed volume, the first speaker module further having a plurality of acoustic ports, the first housing having a first pair of opposing panels that defines a first wedge angle; and a second speaker module having a plurality of electroacoustic drivers and a second housing that together define a second cavity having a second enclosed volume that is greater than the first enclosed volume by a first volume difference, the second housing having a second pair of opposing panels that defines a second wedge angle, one of the opposing panels in the second pair of opposing panels being parallel and substantially adjacent to one of the opposing panels in the first pair of opposing panels, the second speaker module further including a plurality of acoustic ports and a first internal enclosure having a first internal volume that is substantially equal to the first volume difference, wherein the first wedge angle and the second wedge angle are not equal and wherein a portion of the first enclosed volume that is exclusive of the first internal volume defines a volume that is substantially equal to the first enclosed volume.

17. The array of speaker modules of claim 16 wherein the first and second housings each comprise a plurality of panels and wherein the internal enclosure comprises a plurality of internal panels, each of the internal panels being fixed to at least one of the panels of the second housing and the other internal panels.

18. The array of speaker modules of claim 17 wherein at least one of the internal panels is a curved panel.

19. The array of speaker modules of claim 16 wherein the internal enclosure is a box-shaped enclosure.

20. The array of speaker modules of claim 16 wherein at least one of the electroacoustic drivers is a woofer.

21. The array of speaker modules of claim 20 wherein at least one of the electroacoustic drivers is a compression driver.

22. A speaker module having a configurable acoustic cavity, the speaker module comprising:

a housing for a first speaker module, the housing having at least one opening and being configured for attachment to a housing of a second speaker module;

an acoustic driver disposed in each opening of the at least one opening, wherein the housing and the at least one acoustic driver define a cavity having a first enclosed volume; and at least one internal panel attached to an inside of the housing to thereby define an internal volume within the first enclosed volume, the internal volume being substantially equal to a difference between the first enclosed volume and a second enclosed volume defined by a cavity of the second speaker module .

23. The speaker module of claim 22 further comprising a plurality of acoustic ports extending from outside the housing to the enclosed volume.

24. The speaker module of claim 22 wherein the at least one internal panel comprises a curved panel.

25. The speaker module of claim 22 wherein the at least one electroacoustic driver comprises a woofer.

26. The speaker module of claim 22 wherein the at least one electroacoustic driver comprises a compression driver.

* * * * *